US006984099B2

(12) United States Patent
Yu et al.

(10) Patent No.: US 6,984,099 B2
(45) Date of Patent: Jan. 10, 2006

(54) FUEL PUMP IMPELLER

(75) Inventors: DeQuan Yu, Ann Arbor, MI (US); Norman Nelson Krieger, Milford, MI (US); Stephen Thomas Kempfer, Canton, MI (US); Joseph Grabowski, Grosse Ile, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 43 days.

(21) Appl. No.: 10/430,853

(22) Filed: May 6, 2003

(65) Prior Publication Data

US 2004/0223841 A1 Nov. 11, 2004

(51) Int. Cl.
*F04D 5/00* (2006.01)

(52) U.S. Cl. ..... 415/55.1; 416/237
(58) Field of Classification Search ..... 415/55.1–55.7; 416/175, 203, 237
See application file for complete search history.

(56) References Cited

U.S. PATENT DOCUMENTS

| | | | | |
|---|---|---|---|---|
| 1,689,579 A | | 10/1928 | Burks | |
| 1,768,242 A | | 6/1930 | Ferguson | |
| 1,865,504 A | * | 7/1932 | Bird | 415/55.1 |
| 1,920,484 A | | 8/1933 | Siemen et al. | 103/96 |
| 2,015,200 A | | 9/1935 | Spoor | 103/96 |
| 2,842,062 A | | 7/1958 | Wright | |
| 3,259,072 A | | 7/1966 | Carpenter | |
| 3,418,991 A | | 12/1968 | Shultz et al. | |
| 3,804,547 A | | 4/1974 | Hagemann | 415/53 |
| 3,947,149 A | | 3/1976 | MacManus | |
| 4,209,284 A | | 6/1980 | Lochmann et al. | |
| 4,231,718 A | | 11/1980 | Ruhl et al. | 417/366 |
| 4,403,910 A | | 9/1983 | Watanabe et al. | |
| 4,734,008 A | | 3/1988 | Roth | |
| 4,804,313 A | | 2/1989 | Nasvytis | 415/53 T |
| 4,834,612 A | | 5/1989 | Lahn et al. | |
| 4,923,365 A | * | 5/1990 | Rollwage | 415/55.1 |

(Continued)

FOREIGN PATENT DOCUMENTS

| | | |
|---|---|---|
| EP | 0118027 | 9/1984 |
| EP | 1059436 | 12/2000 |
| GB | 0886142 | 1/1962 |
| GB | 2253010 | 8/1992 |
| GB | 2392212 | 2/2004 |
| WO | 0321109 | 3/2003 |

OTHER PUBLICATIONS

Search Report from corresponding United Kingdom Application Ser. No. 0409158.3 dated Mar. 18, 2005 (1 p.).

*Primary Examiner*—Edward K. Look
*Assistant Examiner*—Richard A Edgar
(74) *Attorney, Agent, or Firm*—Jones Day

(57) ABSTRACT

A ring impeller includes a central hub with a first row of vanes extending from the hub and a second row of vanes extending from the hub adjacent to and staggered from the first row of vanes. The vanes in each row are grouped to form adjacent vane pairs and a partition wall is positioned between each of the vanes within the vane pairs. A rib extends radially from the hub in alignment with the partition wall and is positioned between each vane pair. The bottom thickness of the partition wall is the same thickness as the rib. The partition wall includes a reduced material area at its forward and rear edges. The vanes in the first row are unevenly spaced and the vanes in the second row are spaced equidistantly between the vanes in the first row. The spacing of the vanes in the first row may be about 70% to about 140% of a spacing equal to an equal spacing. Some of the vanes may have a height that is less than the height of other vanes.

9 Claims, 8 Drawing Sheets

U.S. PATENT DOCUMENTS 5,011,367 A 4/1991 Yoshida et al. ..... 415/55.1
5,024,578 A 6/1991 Vansadia ..... 415/55.1
5,123,809 A 6/1992 Ito ..... 415/55.1
5,163,810 A 11/1992 Smith ..... 415/55.1
5,209,630 A 5/1993 Roth
5,215,429 A 6/1993 Sun ..... 415/55.4
5,281,083 A 1/1994 Ito et al. ..... 415/55.1
5,284,417 A 2/1994 Yu ..... 415/55.1
5,310,308 A 5/1994 Yu et al. ..... 415/55.6
5,330,319 A 7/1994 Yu et al. ..... 415/55.1
5,336,045 A 8/1994 Koyama et al. ..... 415/55.1
5,364,238 A 11/1994 Yu ..... 417/432.14
5,375,971 A 12/1994 Yu ..... 415/55.1
5,375,975 A 12/1994 Yu et al. ..... 415/182.1
5,401,143 A 3/1995 Yu ..... 417/203
5,401,147 A 3/1995 Yu ..... 417/423.14
5,409,357 A 4/1995 Yu et al.
5,413,457 A 5/1995 Tuckey ..... 415/55.6
5,486,087 A 1/1996 Treiber et al. ..... 415/55.1
5,487,650 A 1/1996 Gaston et al. ..... 417/423.3
5,513,950 A 5/1996 Yu
5,516,259 A 5/1996 Niederkofler et al. ..... 415/55.1
5,527,149 A 6/1996 Moss et al.
5,549,446 A 8/1996 Gaston et al.
5,551,835 A 9/1996 Yu et al. ..... 415/55.1
5,551,842 A 9/1996 Schmid et al. ..... 417/203
5,599,163 A 2/1997 Heath et al. ..... 415/55.1
5,702,229 A 12/1997 Moss et al. ..... 415/55.4
5,733,111 A 3/1998 Yu et al. ..... 418/78
5,762,469 A * 6/1998 Yu ..... 415/55.1
5,819,524 A 10/1998 Bosley et al. ..... 60/39.465
5,913,657 A 6/1999 Mollenhauer ..... 415/55.4
5,921,746 A 7/1999 Yu et al. ..... 415/55.1
5,975,843 A * 11/1999 Ebihara ..... 415/55.1
5,984,644 A 11/1999 Yu et al. ..... 417/302
6,068,454 A 5/2000 Gaston et al. ..... 417/356
6,113,360 A 9/2000 Yu et al. ..... 417/310
6,113,363 A 9/2000 Talaski
6,116,850 A 9/2000 Yu ..... 415/55.1
6,152,687 A 11/2000 Wilhelm et al. ..... 415/55.1
6,170,472 B1 1/2001 Gaston et al. ..... 123/509
6,174,128 B1 1/2001 Yu ..... 415/55.2
6,210,102 B1 4/2001 Yu et al. ..... 415/55.1
6,224,323 B1 5/2001 Murase et al.
6,231,318 B1 5/2001 Cotton et al. ..... 417/423.1
6,270,310 B1 8/2001 Gaston et al. ..... 415/55.1
6,296,439 B1 10/2001 Yu et al. ..... 415/55.1
6,296,440 B1 10/2001 Fandrey ..... 415/55.1
6,299,406 B1 * 10/2001 Yu et al. ..... 415/55.1
6,305,900 B1 10/2001 Yu ..... 415/55.1
6,322,319 B1 11/2001 Yoshioka
6,354,279 B2 3/2002 Gaston et al. ..... 123/509
6,422,808 B1 7/2002 Moss et al. ..... 415/55.1
6,425,733 B1 7/2002 Ross
6,491,028 B1 12/2002 Gaston et al. ..... 123/509
6,511,283 B1 * 1/2003 Yoshioka ..... 415/55.1
6,527,505 B2 3/2003 Yu et al. ..... 415/55.1
6,561,765 B2 5/2003 Yu et al. ..... 416/195
6,604,905 B1 8/2003 Yu et al. ..... 415/55.1
6,641,361 B2 11/2003 Yu ..... 415/55.1
6,655,909 B2 12/2003 Yu et al. ..... 415/55.1
6,669,437 B2 12/2003 Yu et al. ..... 415/55.1
6,675,777 B2 1/2004 Gaston et al. ..... 123/509
6,675,778 B1 1/2004 Kemper et al. ..... 123/516
6,688,844 B2 2/2004 Yu ..... 415/55.1
2004/0001769 A1 1/2004 Kempfer et al. ..... 417/423.1
2004/0018080 A1 * 1/2004 Yu et al. ..... 415/55.1

* cited by examiner

FUEL PUMP IMPELLER

FIELD OF THE INVENTION

The claimed invention relates to a fuel pump impeller. In particular, the invention concerns a ring impeller for use with a fuel pump.

BACKGROUND OF THE INVENTION

Regenerative fuel pumps have been used for years in automotive fuel supply applications. Conventional automotive fuel pumps typically have a rotary pumping element, such as an impeller, that is encased within a pump housing. Typical impellers have a plurality of vanes and ribs formed around the periphery of a central hub. Rotation of the impeller draws fuel into a pumping chamber located within the pump housing. The pumping action of the impeller causes fuel to exit the fuel pump housing at high pressure. Regenerative fuel pumps are commonly used in automotive applications because they produce a more constant discharge pressure than other types of pumps. They also typically cost less and generate less audible noise during operation than other known pumps.

Pump efficiency and noise are two characteristics that are considered important when designing a fuel pump impeller. Staggered vane impellers have been used to provide lower pressure pulsation and noise, at the sacrifice of pump efficiency. Staggered vane impellers utilize a first row of vanes on the cover side of the impeller and a second row of vanes on the body side of the impeller. The first row of vanes are staggered relative to the second row of vanes. Partition or connecting walls may be utilized between staggered vanes.

SUMMARY

According to one embodiment of the invention, an impeller includes a central hub, a first plurality of vanes, a second plurality of vanes, a plurality of partition walls, and a plurality of ribs. The first plurality of vanes extend radially from the central hub in a first row. The second plurality of vanes extend radially from the central hub in a second row positioned adjacent to and staggered from the first row. Each of the vanes from the first row is paired with a vane from the second row to form a plurality of pairs of vanes. Each partition wall is positioned between the vanes in the pair of vanes. The plurality of ribs extend radially from the central hub around the circumference of the hub. The ribs are positioned between each of the vane pairs in alignment with the partition walls and have a rib thickness. Each of the partition walls have a bottom thickness and the bottom thickness of the partition walls are equal to the rib thickness. A ring impeller may further include an outer ring coupled to the first and second rows of vanes. A regenerative fuel pump according to this embodiment includes the impeller discussed above, a pump housing having an inlet and an outlet, a motor, and a shaft coupled between the motor and the impeller for driving the impeller to pump fuel from the inlet to the outlet of the housing.

In another embodiment, an impeller includes a central hub, a first plurality of vanes, a second plurality of vanes, and a plurality of partition walls. The first plurality of vanes extend radially from the central hub in a first row. The second plurality of vanes extend radially from the central hub in a second row positioned adjacent to and staggered from the first row. Each of the vanes from the first row is paired with a vane from the second row to form a plurality of vane pairs, with each of the vane pairs having a first row vane and a second row vane. Each partition wall is positioned between each first and second row vane within the pair of vanes. And each partition wall has a forward edge and a rear edge. A first reduced material area is provided on the forward edge of each partition wall where the first row vane meets the partition wall. A second reduced material area is provided on the rear edge of each partition wall where the second row vane meets the partition wall. A ring impeller further includes an outer ring coupled to the first and second rows of vanes. A regenerative fuel pump according to this embodiment includes the impeller discussed above, a pump housing having an inlet and an outlet, a motor, and a shaft coupled between the motor and the impeller for driving the impeller to pump fuel from the inlet to the outlet of the housing.

In yet another embodiment, an impeller includes a central hub, a first plurality of vanes, a second plurality of vanes, and a plurality of partition walls. The first plurality of vanes extend radially outwardly from the central hub in a first row. The second plurality of vanes extend radially outwardly from the central hub in a second row and are positioned adjacent to and staggered from the first row. Each of the vanes from the first row is paired with a vane from the second row to form a plurality of pairs of vanes. Each partition wall is positioned between the vanes in each pair of vanes. The vanes in the first row of vanes are unevenly spaced in a non-repeating pattern and vanes in the second row of vanes are spaced equidistantly between the vanes of the first row of vanes. A ring impeller further includes an outer ring coupled to the first and second rows of vanes. A regenerative fuel pump according to this embodiment includes the impeller discussed above, a pump housing having an inlet and an outlet, a motor, and a shaft coupled between the motor and the impeller for driving the impeller to pump fuel from the inlet to the outlet of the housing.

In a further embodiment, an impeller includes a central hub, a first plurality of vanes, a second plurality of vanes, and a plurality of partition walls. The first plurality of vanes extend radially from the central hub in a first row. The second plurality of vanes extend radially from the central hub in a second row positioned adjacent to and staggered from the first row. Each of the vanes from the first row is paired with a vane from the second row to form a plurality of pairs of vanes. Each partition wall is positioned between the vanes of each pair of vanes. The vanes in the first row are unevenly spaced and have a spacing of the vanes that ranges from about 70% to 140% of a spacing equal to an even spacing, with the even spacing being the spacing that would occur if the vanes were evenly spaced around the central hub. A ring impeller further includes an outer ring coupled to the first and second rows of vanes. A regenerative fuel pump according to this embodiment includes the impeller discussed above, a pump housing having an inlet and an outlet, a motor, and a shaft coupled between the motor and the impeller for driving the impeller to pump fuel from the inlet to the outlet of the housing.

In another embodiment, an impeller includes a central hub, a first plurality of vanes, a second plurality of vanes, and a plurality of partition walls. The first plurality of vanes extend radially outwardly from the central hub in a first row. The second plurality of vanes extend radially outwardly from the central hub in a second row positioned adjacent to and staggered from the first row. Each of the vanes from the first row is paired with a vane from the second row to form a plurality of pairs of vanes, with vanes in each pair of vanes having the same height. Each partition wall is positioned between the vanes of the pair of vanes. Some of the vanes in the first row have a first height and some of the vanes in the first row have a height that is less than the first height. A ring impeller further includes an outer ring coupled to the first and second rows of vanes. A regenerative fuel pump according to this embodiment includes the impeller discussed above, a pump housing having an inlet and an outlet, a motor, and a shaft coupled between the motor and the impeller for driving the impeller to pump fuel from the inlet to the outlet of the housing.

BRIEF DESCRIPTION OF THE DRAWING FIGURES

DETAILED DESCRIPTION OF THE INVENTION

Figure 1:
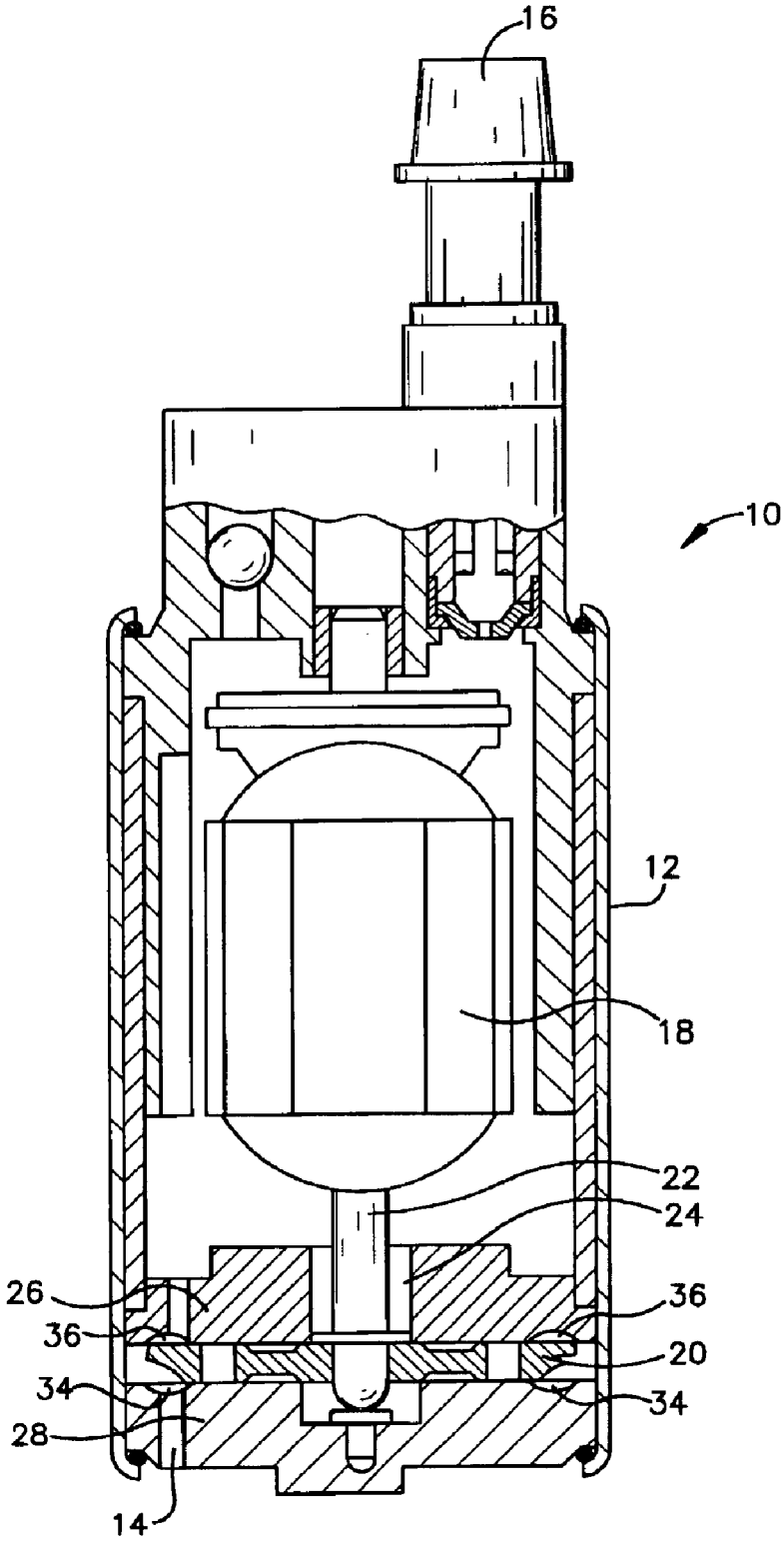
Fig.1 (PRIOR ART)
FIG. 1 is a cross-sectional view of a prior art regenerative fuel pump.
Figure 2:
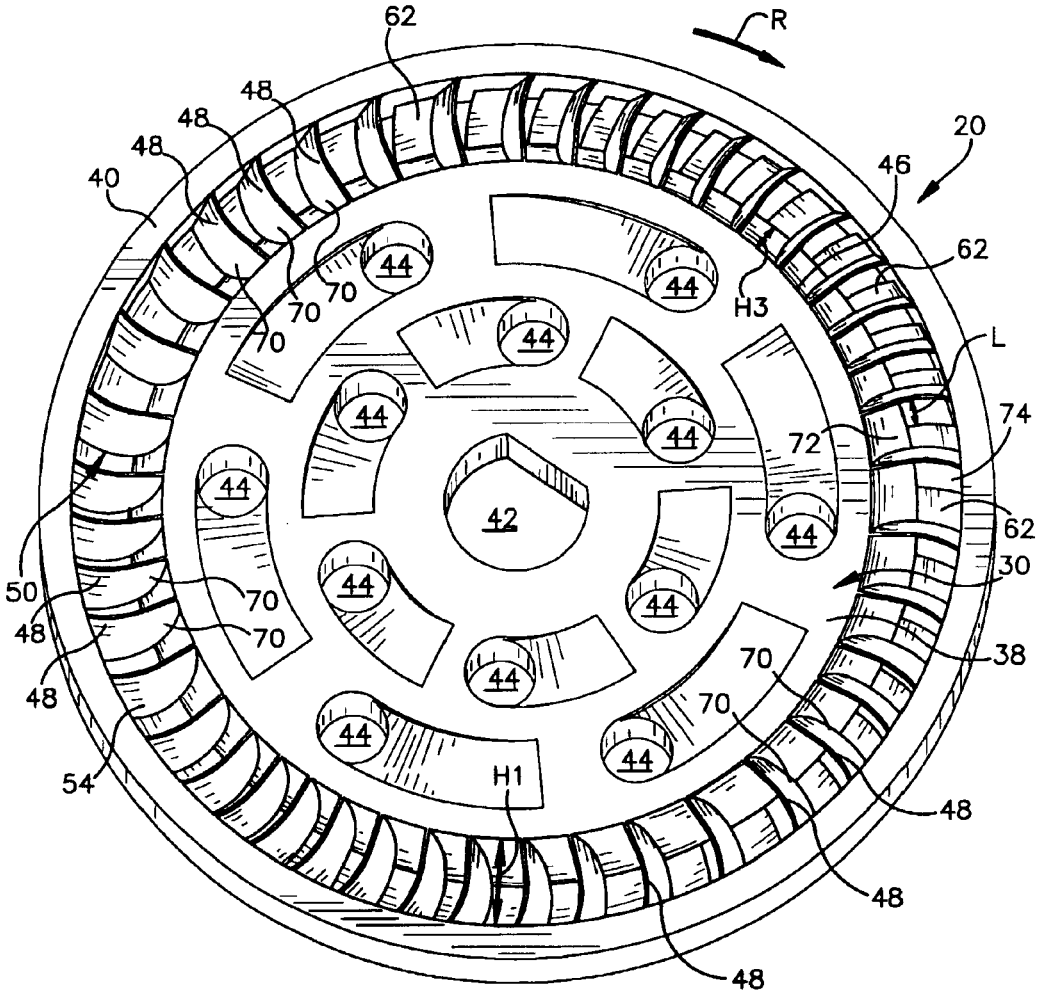
FIG. 2 is a perspective view of a first embodiment of the cover side of a ring impeller according to the invention.

FIG. 1 shows a prior art regenerative fuel pump 10. The pump 10 is surrounded by a housing 12 having an inlet 14 and an outlet 16 for pumping fuel into the pump 10 from a fuel tank (not shown) and out of the pump 10 to the engine of an automotive (not shown). The housing 12 houses a motor 18, an impeller 20, and a shaft 22 coupled between the motor 18 and the impeller 20 for driving the impeller 20. The motor 18 is preferably an electric motor, but other types of motors may also be utilized. The shaft 22 is journaled within a bearing 24. The impeller 20 is encased between a pump body 26 and a pump cover 28. The inlet side of the impeller 20 is the cover side 30, and the outlet side of the impeller 20 is the body side 32. The pump cover 28 has a flow channel 34 for receiving fuel from the inlet 14. The pump body 26 has a flow channel 36 for receiving fuel from the impeller 20. Fuel is drawn into the pump inlet 14 by the impeller 20 from a fuel tank (not shown) or other source. Fuel exits the impeller 20 through the body and flows around the motor to cool the motor 18 before it is discharged through the pump outlet 16 under high pressure.

According to the present invention, an improved impeller 20 is provided for use in a regenerative fuel pump 10, such as that shown in FIG. 1. One embodiment of the impeller 20 is shown in FIGS. 2–9. The impeller 20 has a plurality of vanes that extend radially outwardly from a central hub 38 and terminate at an outer ring 40. The vanes are spaced around the entire circumference of the central hub 38. The central hub 38 is an annular disc that has a shaft opening 42 through which the shaft 22 (shown in FIG. 1) passes to rotate the impeller 20 around the shaft opening 42. The impeller 20 includes pressure balance holes 44 that extend axially through the impeller 20. The pressure balance holes 44 are utilized to keep the impeller 20 centered and balanced within the pump housing 12 upon the introduction of fuel into the housing inlet 14.

Referring to FIGS. 3–8, the impeller cover side 30 and body side 32 are shown. The cover side 30, shown in FIG. 3, faces the pump cover 28 and the body side 32, shown in FIG. 5, faces the pump body 26. The impeller 20 includes two rows of vanes 48 that extend radially outwardly from the peripheral surface 46 of the central hub 38, as shown best in FIGS. 6 and 7. A first row of vanes 50 is positioned on the cover side 30 of the impeller 20 and a second row of vanes 52 is positioned adjacent the first row of vanes 50, but on the body side 32 of the impeller 20. In a preferred embodiment, the first and second rows of vanes 50, 52 have a combined width that extends across the entire width W1 of the central hub's peripheral surface 46.

Figure 7:
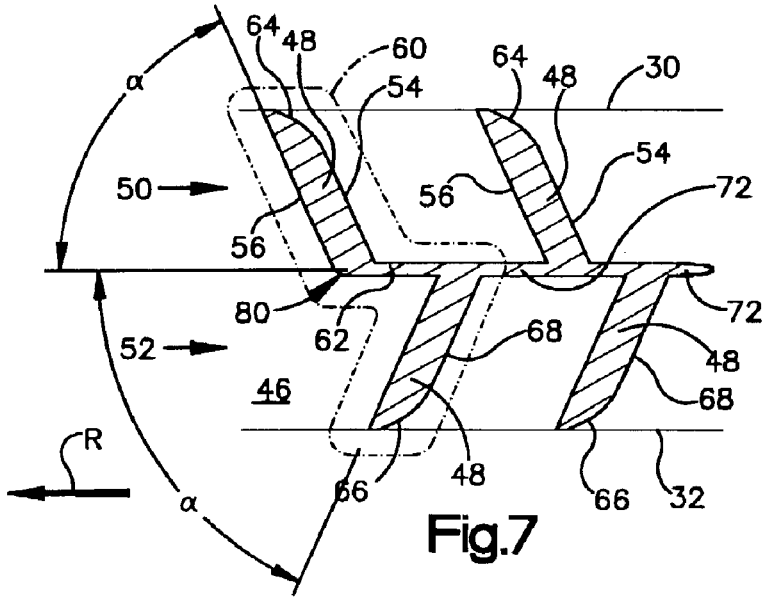
FIG. 7 is a cross-sectional view of the ring impeller of FIG. 5, taken at line 7—7.
Figure 6:
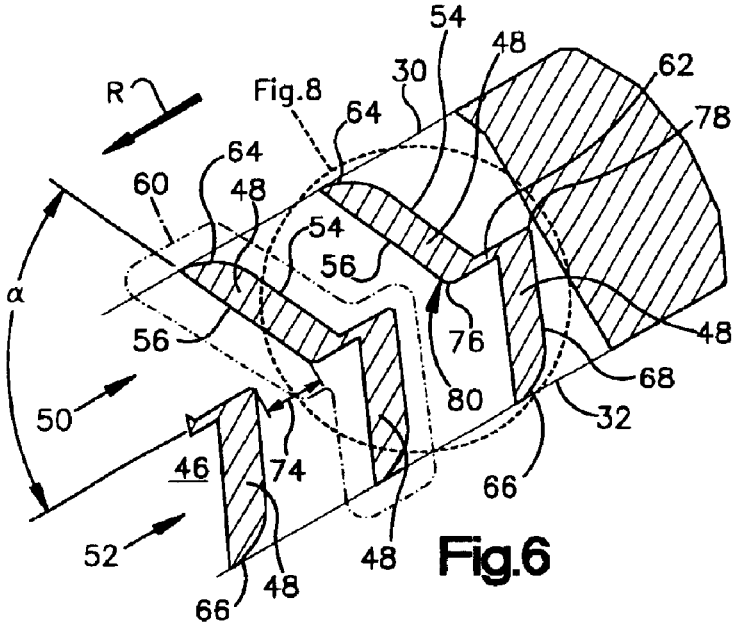
FIG. 6 is a cross-sectional view of the ring impeller of FIG. 5, taken at line 6—6.

The second row of vanes 52 is staggered relative to the first row of vanes 50. Staggering is utilized to obtain a desired sound quality. The vanes 48 preferably have a chevron configuration, such that the first row of vanes 50 extend from the cover side 30 at an angle $\alpha$ other than 90 degrees, as shown in FIGS. 6 and 7. The second row of vanes 52 then extend from the body side 32 at a corresponding angle $\alpha$ other than 90 degrees. As shown in FIGS. 6 and 7, the angle $\alpha$ is less than 90 degrees in the direction of rotation R. In a preferred embodiment, angle $\alpha$ is about $66°\pm2°$. The combination of the first and second rows of vanes 50, 52 form the chevron-shaped configuration.

The first row of vanes 50 are unevenly spaced about the periphery of the central hub 38. They may also be spaced in a non-repeating pattern. The second row of vanes 52 are staggered relative to the vanes in the first row 50 and may also be unevenly spaced in a non-repeating pattern. The number of vanes 48 in the first and second rows is preferably equal, and is a prime number of vanes. For example, 37, 43, or 47 vanes may be provided in each row, among other prime numbers of vanes. The number of vanes 48 will be in part dependent on the size of the central hub 38.

In a preferred embodiment, the first row of vanes 50 are spaced at about 70% to about 140% of an even spacing if the vanes were evenly spaced about the periphery of the hub 38. In another embodiment, the spacing is about 70% to about 130% of an even spacing. Other spacings may also be utilized provided they result in random, uneven spacing and a balanced impeller 20.

In determining the spacing of the vanes 48, it is first necessary to determine the even spacing, which can be calculated by dividing the number of vanes by 360°:

$$\text{Even spacing} = \frac{\text{Number of Vanes}}{360°}$$

The result of the above calculation is multiplied by the desired range, such as, 70% to 130%.

$$\text{Lower Range of Spacing} = \text{Even spacing} \times 70\%$$

$$\text{Upper Range of Spacing} = \text{Even spacing} \times 130\%$$

The spacing of the vanes in the first row 50 is then randomly determined, keeping in mind the upper and lower ranges calculated above. In determining the spacing, it is also preferred that the vanes 48 be balanced around the central hub 38.

The spacing for the second row of vanes 52 may be determined using the above formulas, as long as the second row 52 is staggered relative to the first row of vanes 50 and the vanes remain balanced around the central hub 38. In another, preferred embodiment, the vanes 48 in the second row 52 are spaced mid-way between the vanes in the first row 50. By positioning the vanes in the second row 52 mid-way between the vanes in the first row 50, the vanes in the second row 52 will be unevenly spaced. In addition, if the vanes in the first row 50 are positioned in a non-repeating pattern, the vanes in the second row will also be spaced in a non-repeating pattern using the mid-way spacing. As shown in FIG. 7, each second row 52 vane is preferably spaced mid-way between the trailing edge 54 of the forward vane and the leading edge 56 of the rearward vane in the first row of vanes 50.

Each of the vanes 48 in the first row of vanes 50 are paired with a vane 48 in the second row of vanes 52 to form pairs of vanes 60. It is preferred that each vane 48 in the first row 50 be paired with a vane 48 in the second row 52 that is adjacent and behind each vane in the first row 50. A partition wall 62 joins each of the vanes in the pair 60. In a preferred embodiment, each of the vanes in the pair 60 and the partition wall 62 all have the same height H1, which extends to and joins with the outer ring 40 of the impeller 20. In an alternative embodiment, the vanes in each pair 60 and the partition wall 62 may have a height H2 that is shorter than the distance from the peripheral surface 46 of the central hub 38 to the outer ring 40, as will be discussed in greater detail below.

Each of the vanes 48 in the first row of vanes 50 has a chamfered or curved surface 64 on the trailing edge 54 at the cover side 30 of the vanes 48. In one embodiment, the angle of the curved or chamfered surface 64 is about 25°±2° relative to the direction of rotation R. Each of the vanes 48 in the second row of vanes 52 has a chamfered or curved surface 66 at the trailing edge 68 at the body side 32 of the vanes 48. In one embodiment, the angle of the curved or chamfered surface 66 on each vane in the second row 52 is about 23°±2° relative to the direction of rotation R of the impeller 20. The angle of the chamfer for the first and second row vanes may be the same or may be different for each row of vanes.

Figure 3:
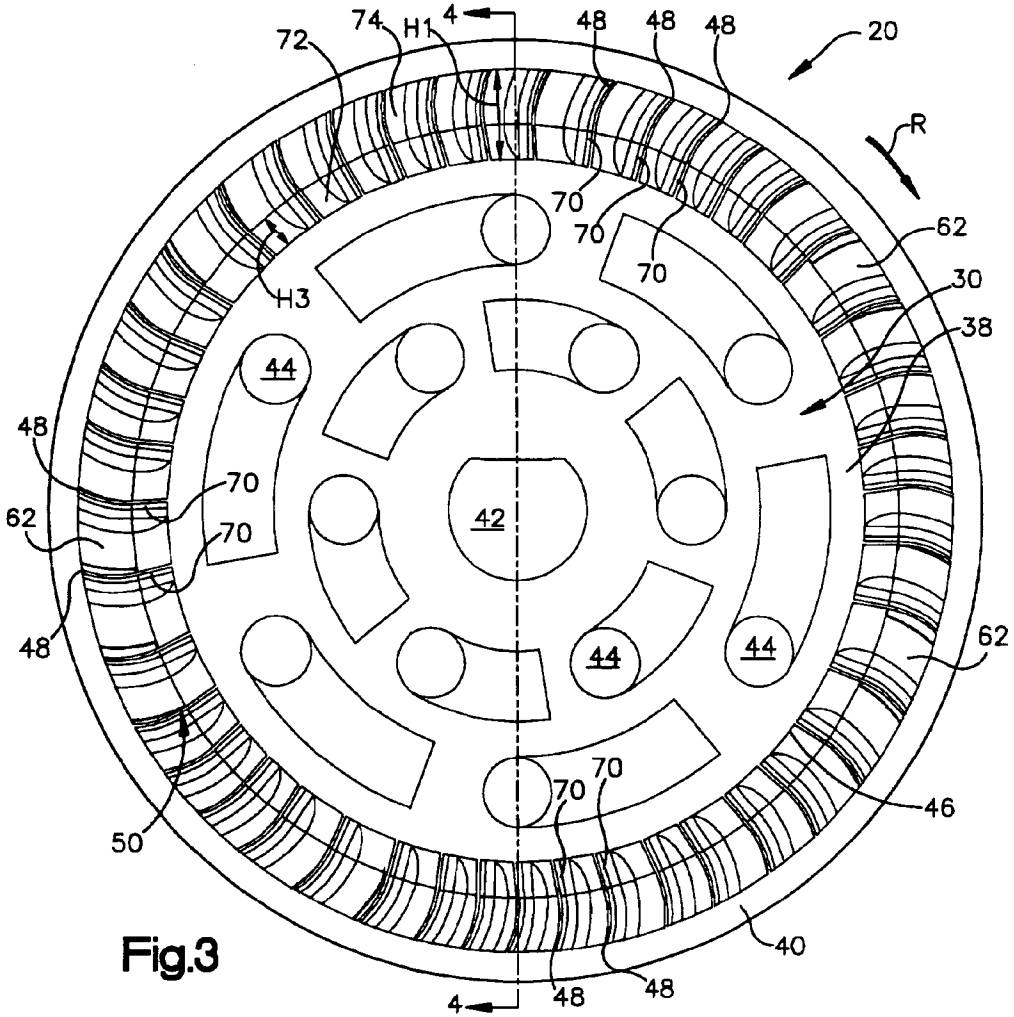
FIG. 3 is plan view of the cover side of the ring impeller shown in FIG. 2.

The vanes of the first and second rows 50, 52 preferably have a similar profile. As shown in FIG. 3, the vanes 48 have a bottom portion 70 that extends at about a 90° angle relative to the peripheral surface 46 of the central hub 38. At approximately half the height H1 of the vanes 48, the vanes 48 curve forward to form a generally convex shape in the direction of rotation R of the impeller 20. The shape shown resembles an airfoil shape. Other shapes may also be utilized.

Figure 4:
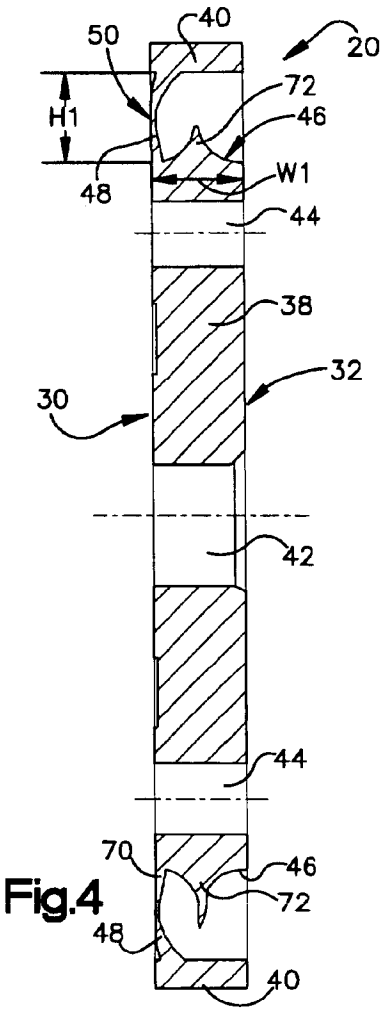
FIG. 4 is a cross-sectional view of the ring impeller of FIG. 3, taken at line 4—4.

A central rib 72 extends radially outwardly from the central hub 38 between each of the adjacent pairs 60 of vanes, as shown in FIGS. 3 and 4. The central rib 72 has a height H3 that is less than the height of the adjacent vanes 48 and partition walls 62. The length L of each central rib is equal to the length of the vane groove, which is the axially extending opening 74 between each adjacent pair 60 of vanes. The use of a central rib 72 helps to lower noise and raise impeller efficiency.

In a preferred embodiment, the central rib 72 has a cross-section that is V-shaped, or generally V-shaped. The rib 72 may alternatively have a ¼ circle or wedge shape. Other shapes may also be utilized. The partition walls 62 are an extension of the central rib 72 such that the combination of the central rib 72 and partition walls 62 form a continuous wall around the centerline of the central hub 38.

Figure 8:
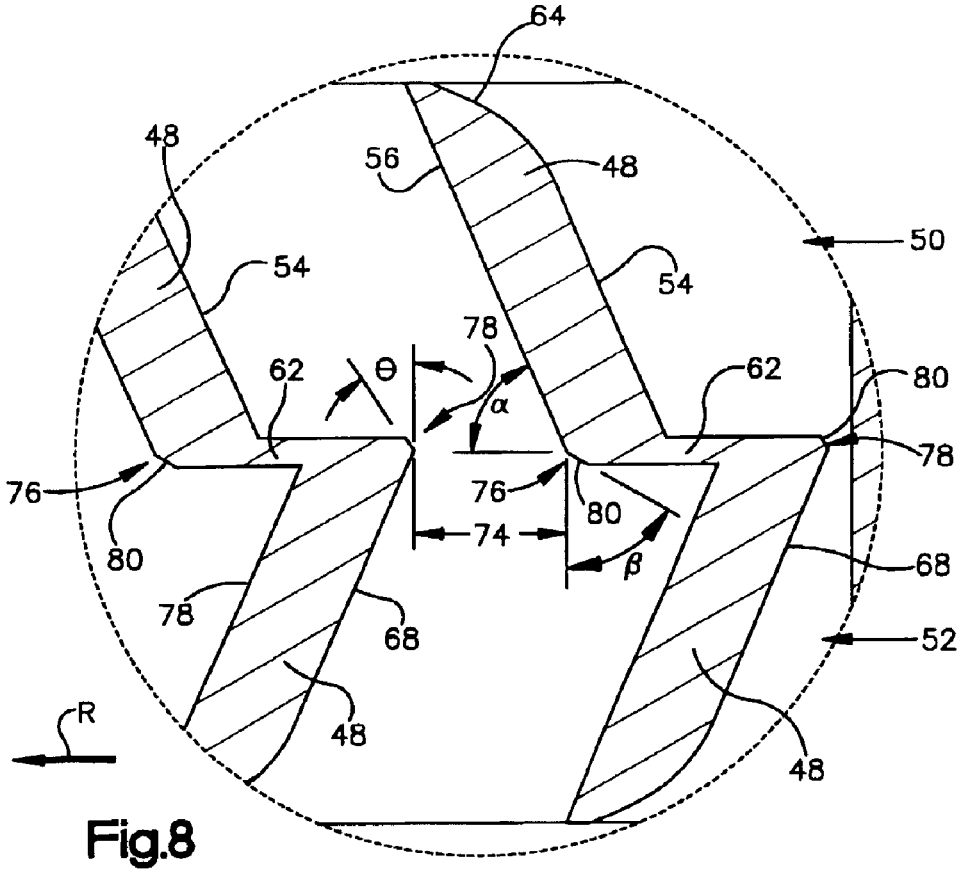
FIG. 8 is an enlarged cross-sectional view of FIG. 7, taken at encircled area 8—8.

As shown best in FIG. 8, the forward edge 76 and rear edge 78 of the partition wall 62 each include an area 80 where material is removed from the edges 76, 78 in order to reduce the sharpness of the corner between the vanes 48 and the partition wall 62. Softening of the corner helps to reduce the likelihood of cavitation problems. In particular, the area 80 of the partition wall 62 that is removed may be a rounded edge, a chamfer, or a notch, among other surface treatments. The length of the area 80 that is removed may extend from the top of the partition wall 62 to the top of the central rib 72, or may extend part of the distance from the top of the partition wall 62 to the top of the central rib 72. The width W2 of the material removed is preferably equal to half of the partition wall 62 width although other widths may also be desirable. In one embodiment, the chamfer at the forward edge 76 of the partition wall 62 is formed at an angle β of 45°±0.5° relative to the direction of rotation R and the chamfer at the rearward edge 78 of the partition wall 62 is formed at an angle θ of 45°±0.5° relative to the direction of rotation R. The angles β and θ may be the same, or may be different.

Figure 9:
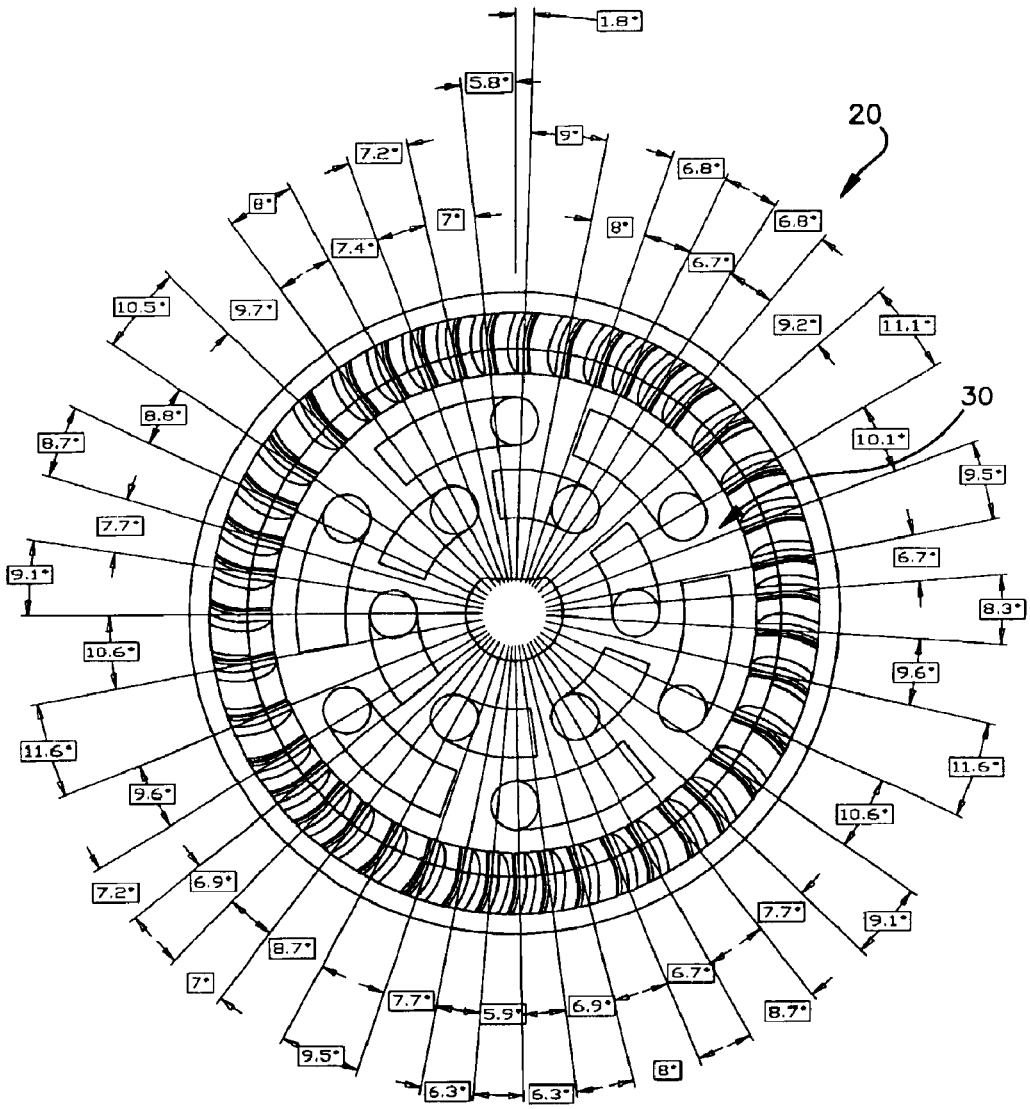
FIG. 9 is a plan view of the cover side of one embodiment of a ring impeller according to the invention.
Figure 10:
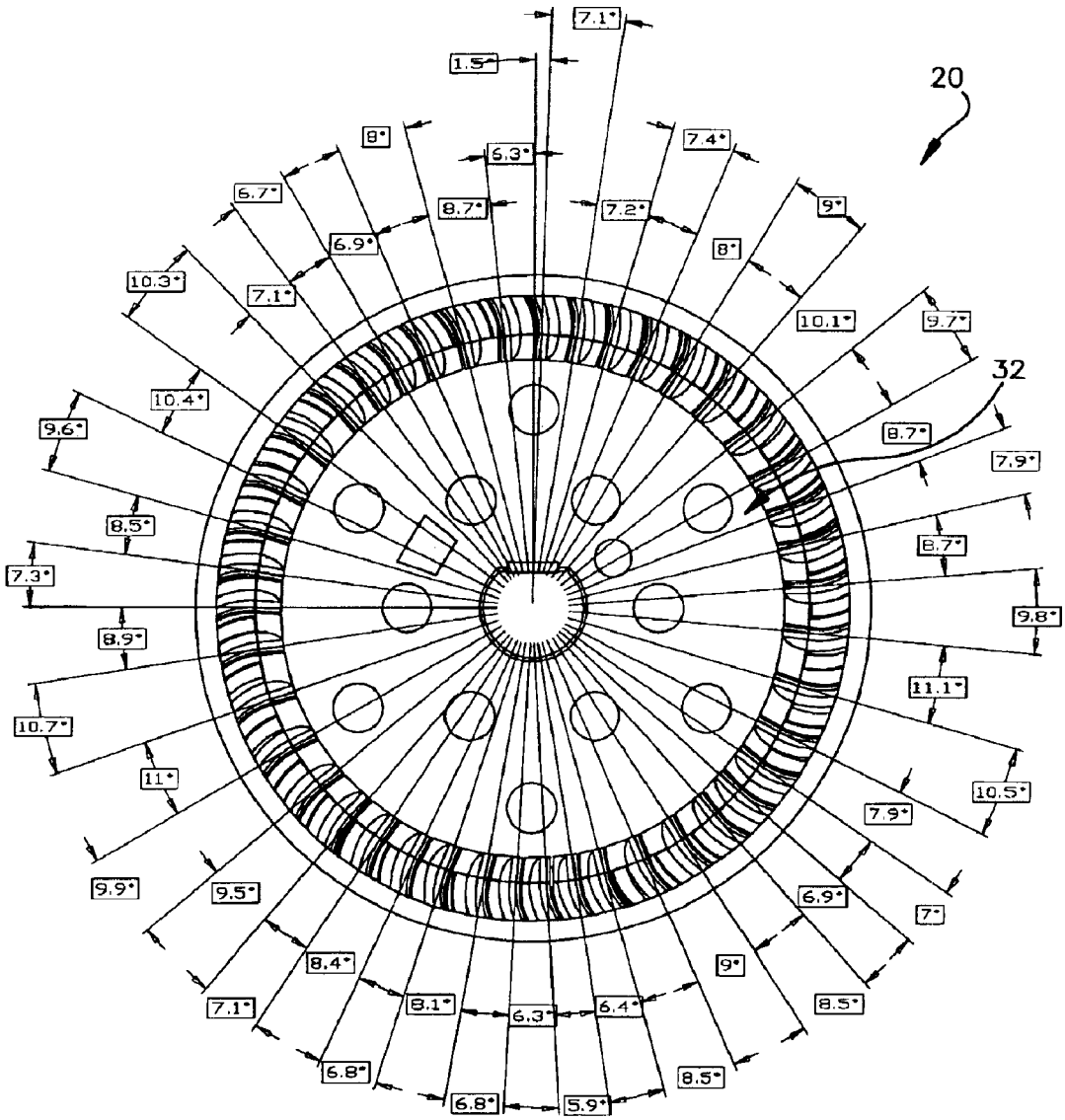
FIG. 10 is a plan view of the body side of the ring impeller shown in FIG. 9.

An example of an impeller 20 having 43 vanes in each row that incorporates uneven, non-repeating spacing, as discussed above, is shown in FIGS. 9 and 10. FIG. 9 shows the spacing for the first row of vanes 50 on the cover side 30 and FIG. 10 shows the spacing for the second row of vanes 52 on the body side 32 of the same impeller. In determining the spacing, a 70% to 140% range was utilized according to the following calculations:

$$\text{Even spacing} = \frac{\text{Number of Vanes}}{360^\circ} = \frac{43}{360^\circ} = 8.4^\circ$$

$$\text{Lower Range of Spacing} = \text{Even spacing} \times 70\% = 8.4^\circ \times 70\% = 5.9^\circ$$

$$\text{Upper Range of Spacing} = \text{Even spacing} \times 140\% = 8.4^\circ \times 140\% = 11.6^\circ$$

Thus, in an embodiment utilizing 43 vanes in the first and second rows 50, 52 with an uneven spacing of 70% to 140% of even spacing, a spacing ranging from 5.9° to 11.6° is preferred.

Figure 11:
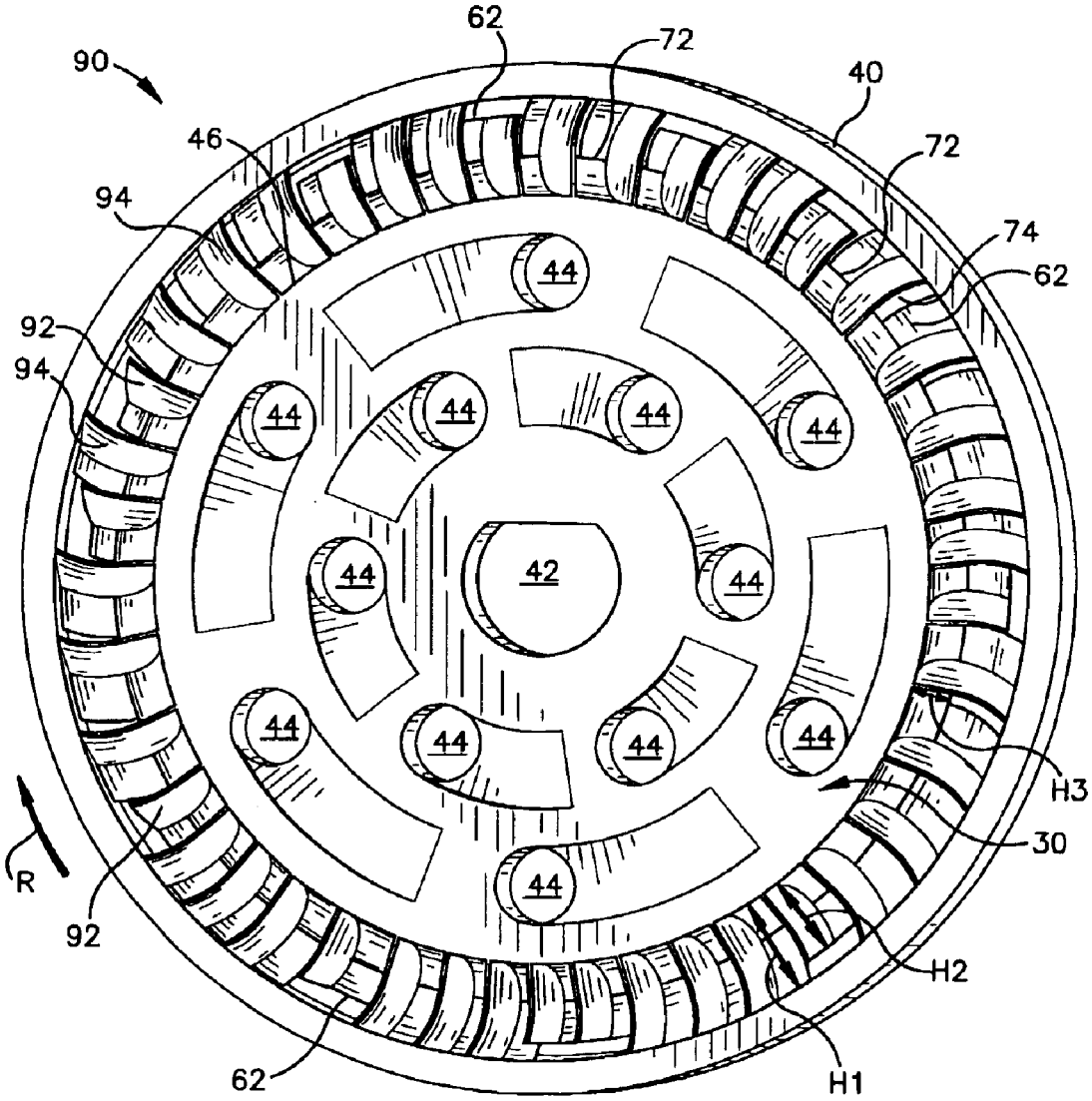
FIG. 11 is a perspective view of an alternative embodiment of the cover side of a ring impeller according to the invention.

FIG. 11 shows an alternative embodiment of the ring impeller 90 according to the invention. The ring impeller 90 utilizes the same spacing as discussed above, but also utilizes shortened vanes 92 in combination with full length vanes 94. The full length vanes 94, like those discussed above in connection with FIGS. 1–10, extend from the outer periphery of the central hub 38 to the outer ring 40, but do not touch the outer ring 40 of the impeller 90. In one embodiment, the shortened vanes 92 are about ⅔ the height H1 of the full-length vanes 94.

The shortened vanes 92 are preferably randomly spaced between the full-length vanes 94, and may be provided singly, or in groups. As shown in FIG. 11, some of the vane pairs 60 are single shortened vanes while some of the vane pairs include two vane pairs 60 that are positioned side-by-side within the row. The pairs of vanes 60 and accompanying partition walls 62 each preferably have the same height. Thus, where the first vane in the pair 60 is full-length, the second row vane and partition wall within the vane pair are also full length. Where the first row vane is shortened, the second row vane and partition wall within the vane pair 60 are also shortened. In a preferred embodiment, as shown in FIG. 11, all the shortened vanes 92 have the same height H2, although other embodiments may be provided where the shortened vanes have differing heights. The shape of the shortened vanes 92 is preferably similar or the same as the shape of the full-length vanes.

Figure 5:
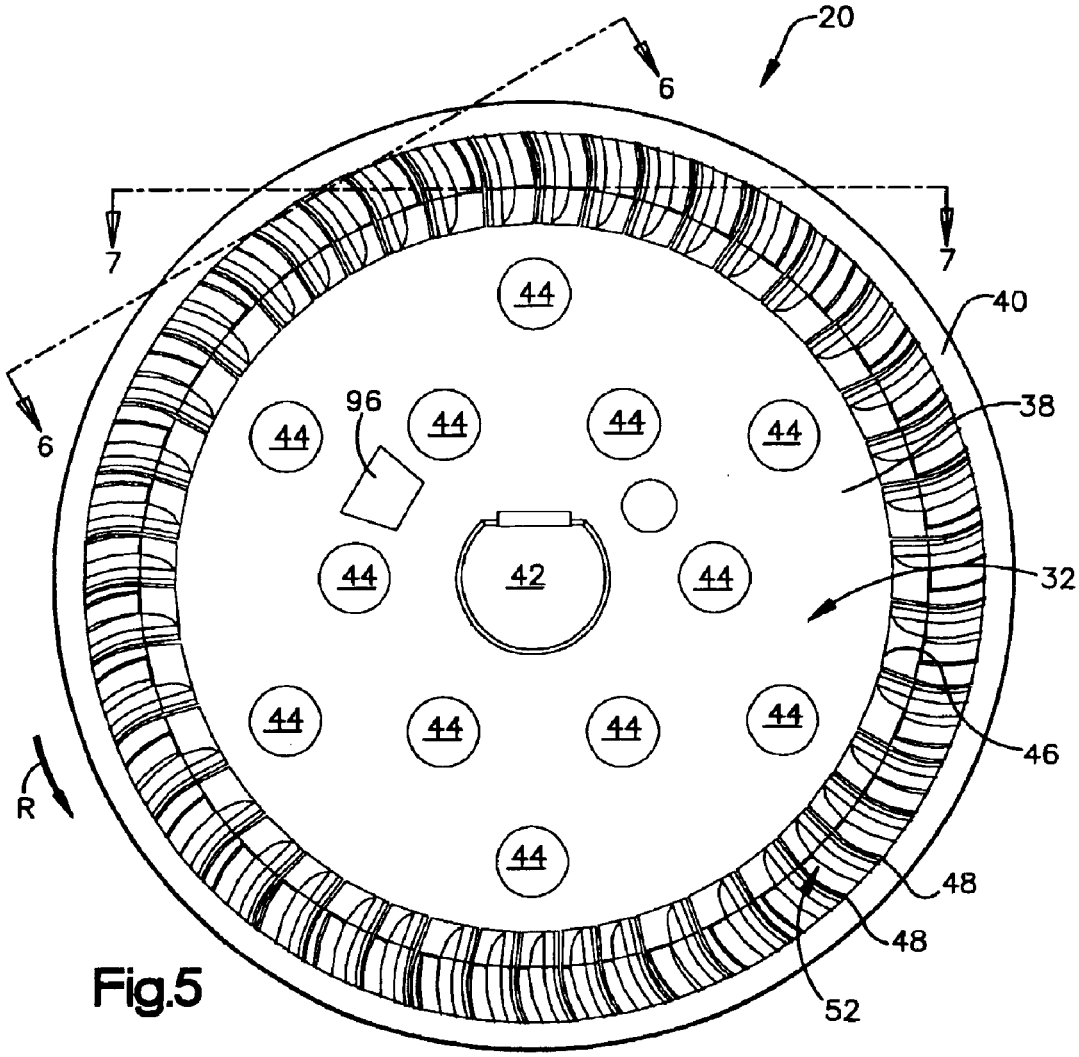
FIG. 5 is a plan view of the body side of the ring impeller shown in FIG. 2.

The impeller 20, 90 is preferably formed of a plastic material using an injection molding process. Types of materials that may be utilized include phenolics or PPS (thermoplastic), among other types of materials. Material may be injected into a mold on the cover side 30 of the impeller 20, 90. A material recycling code may be provided in a recess 96 formed on the impeller 20, 90, such as on the body side 32 of the impeller 20, 90 as shown in FIG. 5.

While the above concepts are discussed in the context of a ring impeller, they may also be utilized in a no-ring impeller.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. An impeller comprising:

a central hub;

a first plurality of vanes extending radially from the central hub in a first row;

a second plurality of vanes extending radially from the central hub in a second row positioned adjacent to and staggered from the first row, each of the vanes from the first row being paired with a vane from the second row to form a plurality of vane pairs, with each of the vane pairs having a first row vane and a second row vane; and a plurality of partition walls, each partition wall being positioned between each first and second row vane within the pair of vanes, and having a forward edge and a rear edge, wherein each partition wall has a first reduced material area on the forward edge thereof where the first row vane meets the partition wall and a second reduced material area on the rear edge thereof where the second row vane meets the partition wall.

2. The impeller of claim 1, wherein the first reduced material area is one of a chamfer, a rounded edge, and a notch; and the second reduced material area is one of a chamfer, a rounded edge, and a notch.

3. The impeller of claim 1, wherein the first and second reduced material areas have a height of about half or less than half the height of the partition wall.

4. The impeller of claim 1, further comprising a plurality of ribs extending radially outwardly from the central hub around the circumference thereof, the ribs being positioned between each of the vane pairs and having a top edge.

5. The impeller of claim 4, wherein the first reduced material area extends from above the top edge of the adjacent rib to the top of the adjacent vane.

6. The impeller of claim 1, wherein the number of vanes in the first row equals the number of vanes in the second row, and the number of vanes in the first row is a prime number of vanes.

7. The impeller of claim 6, wherein the number of vanes in the first row is one of 37, 43, and 47 vanes.

8. A regenerative fuel pump comprising:

a pump housing having an inlet and an outlet;

a motor positioned within the pump housing;

the impeller of claim 1; and a shaft coupled between the motor and the impeller for driving the impeller to pump fuel from the inlet to the outlet of the housing.

9. A ring impeller comprising:

the impeller of claim 1; and an outer ring coupled to the first and second rows of vanes.

* * * * *